United States Patent [19]

Ricono et al.

[11] 4,338,807

[45] Jul. 13, 1982

[54] METHOD OF PRODUCING IMPROVED SERRATED FLATS USED IN THE MANUFACTURING OF GRATING

[75] Inventors: Marion P. Ricono, Kansas City; Harold D. Bridges, Independence, both of Mo.

[73] Assignee: Armco Inc., Middletown, Ohio

[21] Appl. No.: 181,418

[22] Filed: Aug. 26, 1980

[51] Int. Cl.[3] ..... B21H 7/00

[52] U.S. Cl. ..... 72/187; 72/197

[58] Field of Search ..... 72/187, 197, 198; 29/160

[56] References Cited

U.S. PATENT DOCUMENTS

| | | | |
|---|---|---|---|
| 3,653,245 | 4/1972 | Tishken | 72/187 |
| 3,996,780 | 12/1976 | German | 72/187 |
| 4,041,750 | 8/1977 | Moore | 72/187 |

*Primary Examiner*—Lowell A. Larson

*Attorney, Agent, or Firm*—Frost & Jacobs

[57] ABSTRACT

Billets of hot steel are hot rolled through a series of rolling stands to form an elongated flat. This flat is first worked to a predetermined thickness and width and then subjected to an edging pass at a succeeding stand. The edging pass is comprised of a pair of rolls having spaced apart, aligned grooves to receive the flats. The groove in one of the rolls is provided with a plurality of holes having certain characteristics. The depths of the roll grooves, the distance they are spaced apart, the depth and other characteristics of the holes provided in the one grooved roll and the widths of the roll grooves are all adjusted with respect to the predetermined dimensions of the flats entering the edging pass so that desired serrations are imparted to the flat as it passes through the edging pass. A final flat pass may be utilized to finalize the dimensions of the finished, serrated flat. The holes are cut into the roll groove by electric discharge machining. Care is given to the control of the shape of the flat before and after it enters the edging pass. The serrations, however, are imparted to the flat as it passes through the edging pass.

20 Claims, 17 Drawing Figures

EDGING PASS - STAND 31

START FROM HOT
BILLET
2 9/16" X 2 9/16" X 9'-0"
(FOR SERRATED FLATS
OF 1 1/4" X 3/16")

STAND 22

STAND 23

STAND 28

STAND 29

STAND 30

EDGING PASS - STAND 31

(APPROX. 5 TIMES ENLARGED)

METHOD OF PRODUCING IMPROVED SERRATED FLATS USED IN THE MANUFACTURING OF GRATING

TECHNICAL FIELD

The method of this invention pertains to the production of rectangular shaped flats or bars such as those used in the manufacture of grating; these flats or bars may have other structural applications as well. Such grating, for example, may be of the type used for floors, bridge decking, fire escapes and the like. The invention has to do specifically with an improved process for producing a notched or serrated surface on at least one edge of a flat bar during a hot rolling process. The invention produces a finished hot rolled shape ready for immediate assembly into grating and the like.

BACKGROUND ART

An extensive preliminary patentability search was not conducted with respect to the instant invention. The following United States Patents, however, are believed representative of the art which existed prior to this invention: Nos. 3,646,794 Tishken; 3,653,245 Tishken; 3,928,998 Torres; 3,948,013 Lobaugh; and 3,996,780 German. These patents disclose various kinds of serrated shapes. In all instances, however, this prior art formed the serrations by cold working.

The Tishken patents, see especially '245 at FIG. 6 and column 3, line 58 to column 4, line 5, employ generally trapezoid-shaped teeth to form notches in strips of grating workstock by cold rolling. Torres teaches the use of a pair of channeled rollers having in their bottom walls pluralities of holes having cap-shaped bottom portions, see FIGS. 5b and 13 along with the passage from line 56 of column 6 through line 11 of column 7. Lobaugh is of interest in its teaching of how to form a grating using bars, see FIG. 3, although it is silent as to how the bar itself is produced. Finally, the German patent, see FIG. 5 and column 3 at lines 30 to 44 along with column 5 at line 26 through column 6 at line 15, shows the use of a pair of grooved rolls, one of them being provided with teeth, to impart notches to an edge of a strip, all of this being done by cold working of the steel.

There are obvious problems associated with cold working. These include the difficulty of maintaining the bars straight both before and after forming the notches, the difficulty of preventing bulging of the bars as caused by cold working on a narrow edge, the slow speeds involved, the large energy requirements and the cost of the equipment.

DISCLOSURE OF THE INVENTION

The instant invention produces a finished hot rolled serrated shape ready for immediate assembly into grating or the like; such shape may have other structural applications as well. The conventional processing steps encountered in cold working are omitted. These steps include slitting, leveling or flattening, cold working and possibly deburring. The cost of the equipment associated with the practice of the instant invention, and the energy to operate it, are much less than in the prior art. The present invention, for example, doesn't use any additional energy for that required to produce standard hot mill shapes. Furthermore, production speeds of up to about 1400 feet per minute have been achieved as compared to a cold working process wherein it is believed production may be as low as about 20 feet per minute.

The advantages of this invention are realized by cutting holes or notches of a particular configuration into a roll groove and by controlling the flat as it comes into a final edging stand in a particular manner. Both of these factors must be observed in order to insure that the flat material will be forced down into the roll holes or notches sufficient to form the serrations desired.

More specifically, the hole or notch configuration is that of a trapezoid. These holes are formed in one of the grooved edging rolls by using electrical discharge machining (EDM). Electrode tips having the desired trapezoid configuration are used in the EDM process. After several notches have been made, the electrode is removed and reground to the specific configuration that is required.

The height (width) of the flat entering the edging pass, the thickness of the flat, the depth of the roll grooves, the amount of roll parting (distance between the two rolls utilized in the edging pass or stand), the width of the roll groove at its bottom, the width of the roll groove at its surface, the depth of the hole, and the shape of the hole are all factors which must be controlled in a particular manner, with a particular relationship, to achieve the specific finished flat desired.

All of the foregoing results not only in the production of an improved serrated flat for use in the manufacture of grating and other structural members but it also permits this to be accomplished with less die wear because of using the hot rolling technique, speed of production is tremendously increased, less power is required to operate the equipment, capital investment for such equipment is minimized, and the product off the hot mill is ready for end use.

DETAILED DESCRIPTION OF THE INVENTION

Figure 1:
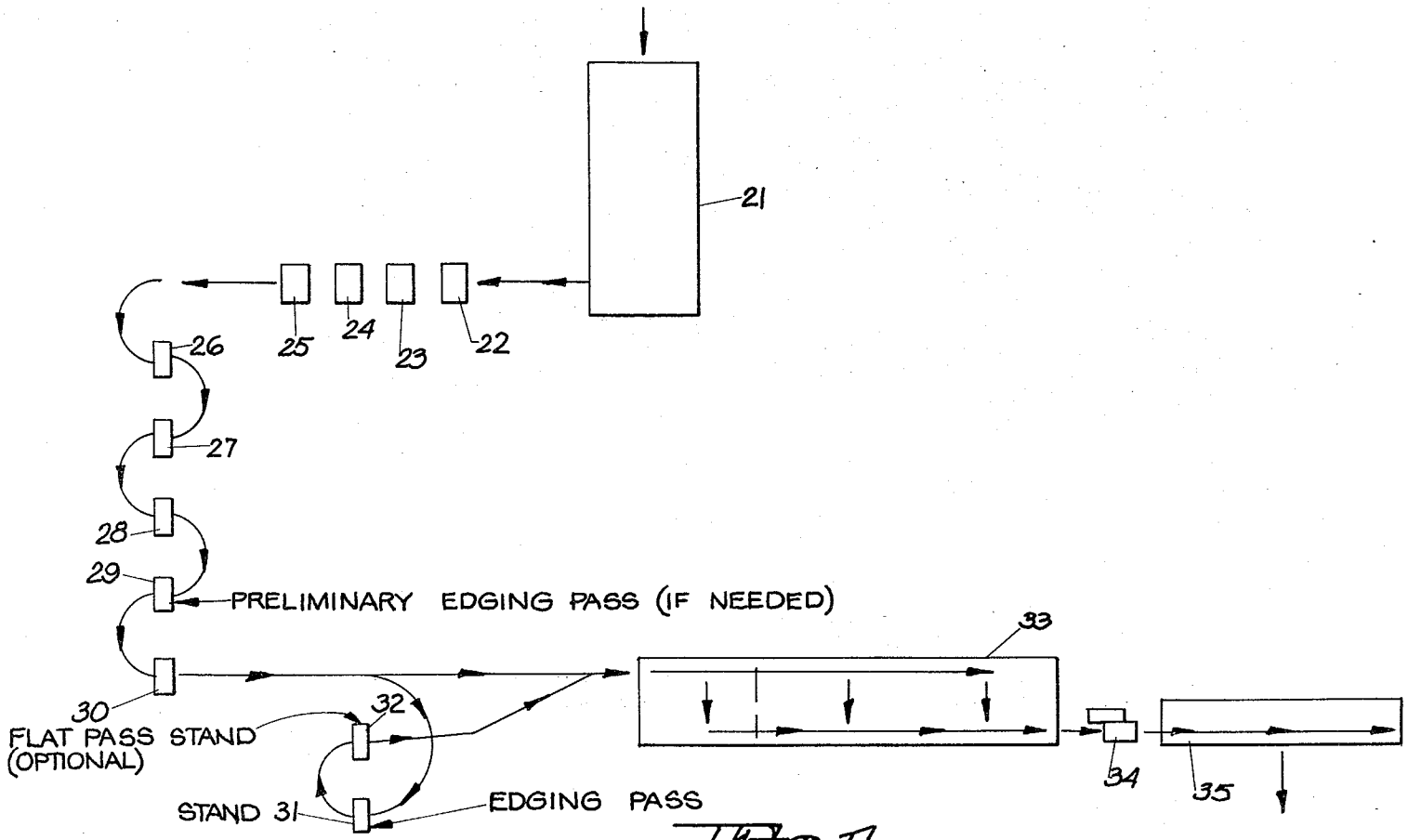
FIG. 1 is a schematic diagram of a 10" (diameter of the rolls) finishing mill modified for the practice of this invention.
Figure 2:
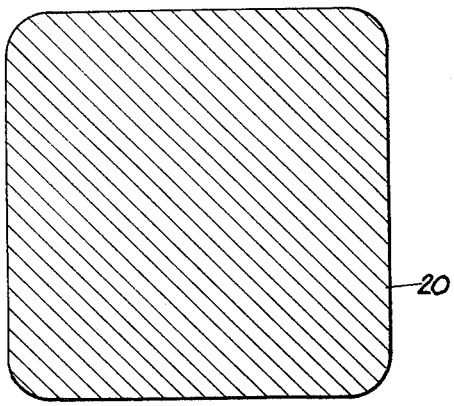
FIG. 2 represents the shape of a hot billet which will be processed by the invention to form the desired serrated flats.

With reference to FIGS. 1 and 2 a hot billet 20 is processed directly from the furnace 21 through, in this particular embodiment of the invention, a series of four roughing stands 22, 23, 24, and 25, then through a series of five additional stands 26, 27, 28, 29 and 30, then through the two stands 31 (edging) and 32 (optional final flat pass), whereafter the finished, serrated flat may be processed through a cooling bed and sheared to the length desired. The cooling bed 33, bar shear 34 and back shear table 35 are all conventional. The roughing stands 22 through 25 and the stands 26 through 30 as generally depicted herein are also conventional although certain special controls must be observed for the stands 28, 29 and 30 when employed to make the serrated flat of the instant invention. The stand 31 is unique.

It will be understood by those skilled in the art that other mills, and other combinations, and sizes and styles, of roughing stands and additional stands may be used to practice this invention. Some mills, for example, may not differentiate between the roughing stands and the additional stands. Depending on capacity, fewer (or more) stands may be required. Planetary rolling mills, by way of further example, would not employ all of the conventional stands illustrated herein. As will be emphasized herein, however, it is necessay, whatever the nature of the particular mill employed, that the flat or bar entering the novel edging stand 31 be brought to a particular configuration for processing at that stand 31.

The prior art has produced flats without serrated edges by roughing stands and additional stands similar to those diagramatically represented at 22 through 30. As a matter of fact these stands may be used to produce various basic type products including angles, squares, channels, rods and flats. Depending on the final product shape, various roll configurations are used. As indicated, however, the particular roll configurations comprising the stand 31 used to perform the edging pass are novel.

The hot billet 20 processed by this invention to obtain the desired serrated flats may be steel material of a grade desiganted ASTM A-569 Commercial Quality of ASTM A-575 Merchant Quality; these are generally further designated as hot roll carbon steel bars. When rolling 1¼" by 3/16" serrated flats according to this invention the billet may be 2 9/16" by 2 9/16" by 9'0" which gives a continuous rolled flat having a length of 248'. According to customer preference, the bar (serrated flat) is usually sheared to either 24' 1½" or 20' 1½". When hot rolling 1½" by 3/16" serrated flats the billet may be 2 9/16" by 2 9/16" by 10'9" which gives a continuous flat having a length of 248'. Again, according to customer preference, the bar may be sheared to either 24' 1½" or 20' 1½".

It will be understood by those skilled in the art that specific sizes used for billets, finished flats, serrations, roll grooves, roll holes, roll parting and the various stands, including the number of stands and their relationship to one another, are for purposes of illustration, to aid one in understanding the invention, and are not to be considered a limitation on the invention except insofar as they are specifically set forth in the claims to follow. Many of the dimensions, for example, can vary as required, but generally in accordance with certain teachings set forth herein, often by way of formulae developed for that purpose, to produce a variety of serrated flats.

In producing serrations on a rectangular shape during hot rolling according to this invention, the temperature will preferably be above the A3, particularly if the material being processed is steel, as will be understood by those skilled in the art.

Figure 2A:
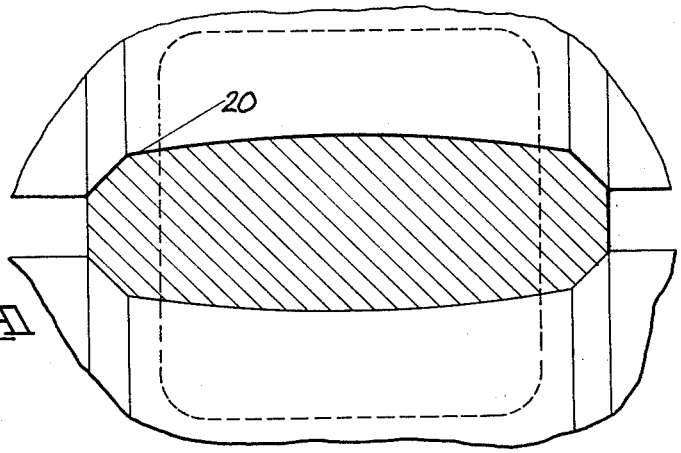
FIGS. 2A through 2D are a series of sketches showing the shape of the billet being rolled as it enters and leaves each of four roughing stands used in this particular but exemplary mill. In all of these Figures the dashed lines show the shape before it enters that particular stand, and the solid with cross hatch show the shape as it leaves that stand.
Figure 2B:
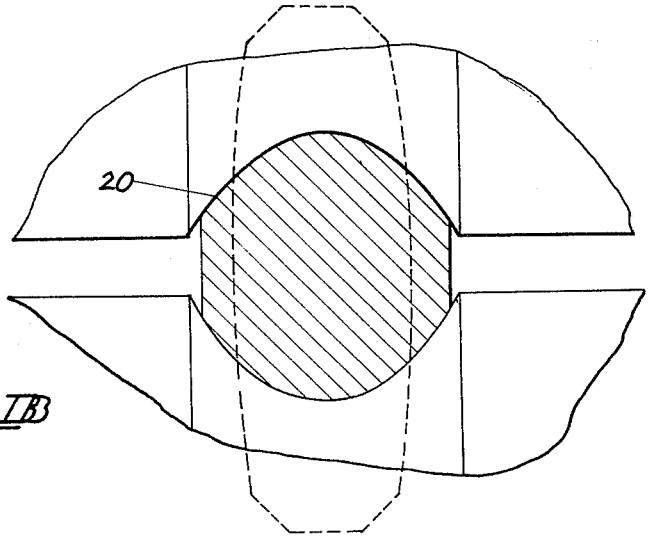
Figure 2C:
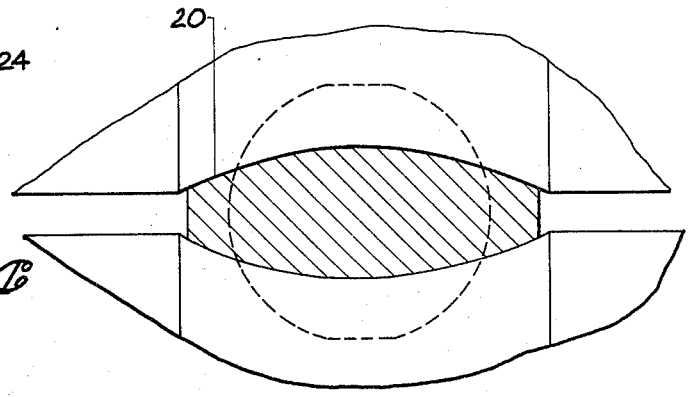
Figure 2D:
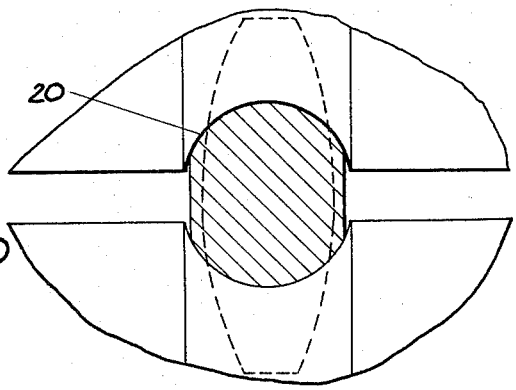
Figure 3A:
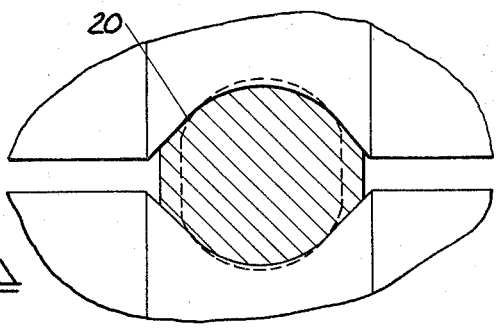
FIGS. 3A through 3E are a series of sketches showing the processing of the hot billet through five finishing stands used in this particular but exemplary mill. Again, in all these Figures the dashed lines show the shape of the flat or bar as it enters a particular stand while the solid with cross hatch show the shape as it leaves that stand.
Figure 3B:
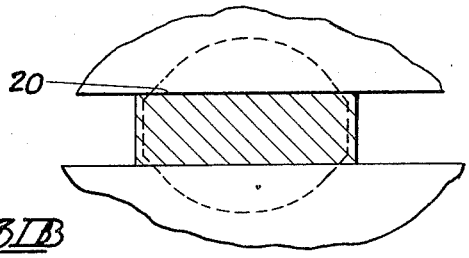
Figure 3C:
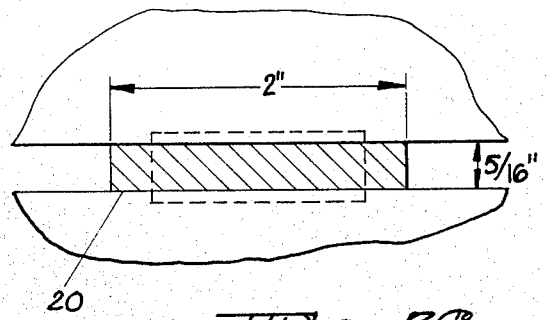
Figure 3D:
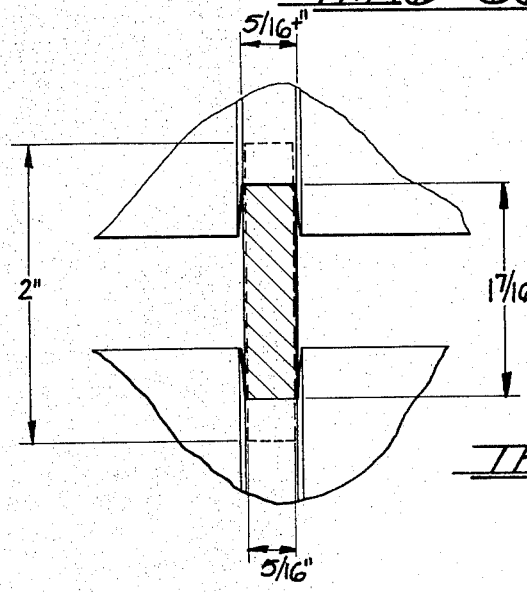
Figure 3E:
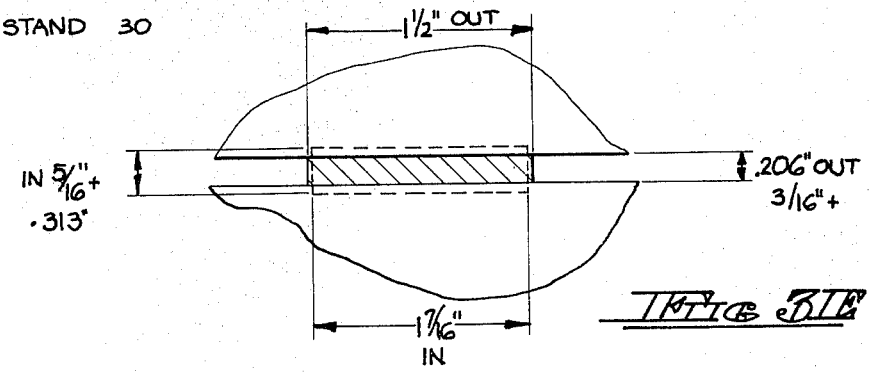

FIGS. 2A throuh 2D illustrate the general shape and size of the hot billet 20 as it passes through the four roughing stands 22 through 25. FIGS. 3A through 3C show the continued progress of the billet 20 through additional stands 26, 27 and 28. These stands 22 through 28 are conventional as will be understood by those skilled in the art. It is here, however, or at a comparable stage if a different mill set-up is utilized, that care must be taken as the flat leaves stand 28 to enter a preliminary edging pass (if needed) at stand 29. This stand 29 may be comprised of a pair of grooved rolls such as those indicated at 36 in FIG. 4; neither of the rolls comprising this stand 29, however, will be provided with the holes or notches indicated at 38 in the roll 37.

The invention is being described in connection with the production of serrated flats having dimensions of 1¼" (height or width) by 3/16" (thickness). Other heights and thicknesses, however, are possible. A height or width of 1½", for example, is not uncommon. As will be amplified later, the 3/16" thickness dimension will be fairly closely adhered to because of the difficulty in forcing thick sections of processed material into the holes or notches provided in the edging pass at stand 31. Certain formulations have been developed to control this and these are set forth hereinafter.

The preliminary edging stand 29, although not illustrated in detail, is conventional in that it does employ a pair of rolls 36 having a groove depth (GD) of ½". Such a stand has been employed in hot rolling flats without a serrated edge. The width of the grooves 39 in the rolls 36 is such as to just nicely receive the thickness of the flat. In these prior operations the shape coming into this preliminary edging pass at stand 29 was not overly critical. More care, however, must be taken in the instant process.

Accordingly, when rolling materials so as to obtain 1¼" by 3/16" serrated flats according to this invention, care should be taken to see that the flat leaving the flat pass at stand 28 is dimensioned approximately 2" by 5/16". This, of course, is the shape as it will enter the preliminary edging pass at stand 29. As will be understood by those skilled in the art, the pair of rolls 36 grooved as indicated at 39 and as described above (generally shown at the left hand side of FIG. 4 but not shown with specific reference to the stand 29 of FIG. 1) will be adjusted so that the flat which leaves the preliminary edging pass as represented by stand 29 will have a dimension of about 1 7/16" by 5/16+". As will also be understood by those skilled in the art, the pass at stand 29 works on the edges only; as a result there will be some "bulging" of the strip with the result that the 5/16" dimension will be slightly increased.

The billet, now substantially flattened to a dimension of 1 7/16" by 5/16+" (0.313+") now proceeds to the flat pass accomplished at stand 30. This pass is such as to flatten the shape from 1 7/6" by 0.313+" to a shape having dimensions of $1\frac{1}{2}$" by 0.206". This is important. This is the shape of the flat as it enters the edging pass at stand 31.

Various stands 22 through 30 have been described, in this example, in connection with bringing a starting billet to a flat of a proper size to be received by the stand 31 for the edging pass which imparts the desired serrations to the flat. Depending on the type of rolling mill used, however, some of these stands may be eliminated, or substituted for, or, for that matter, more stands could be employed. In this example the preliminary edging pass at stand 29 and the flat passes at stands 30 and 32 are preferred but not necessarily mandatory. As indicated, it may be possible to control the flat's dimensions for entry into edging stand 31 by other means. Only this edging pass 31 is required when the flat's dimensions are properly controlled in the preceeding rolling operations.

Figure 4:
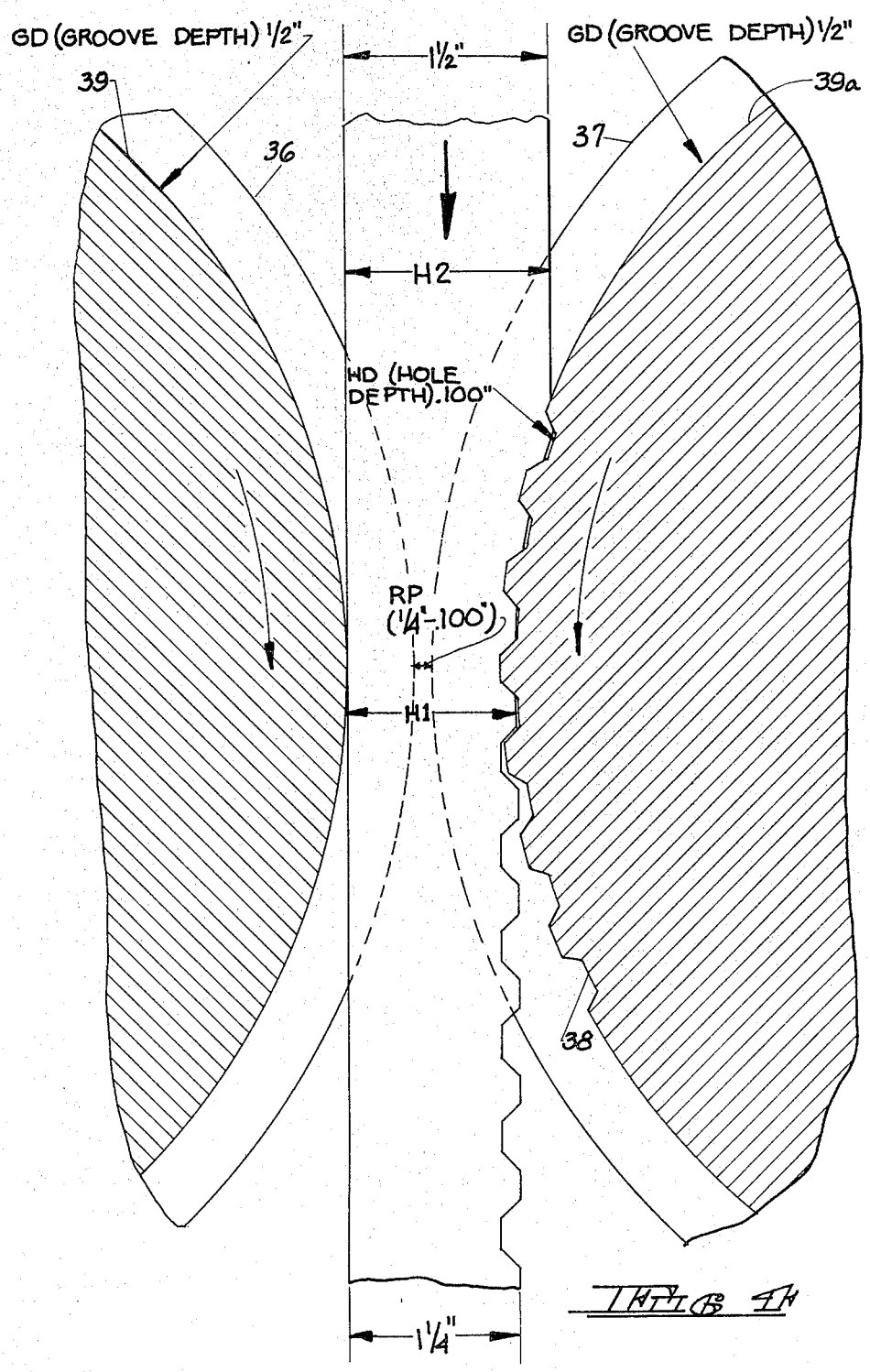
FIG. 4 is a diagramatic, schematic (partly in section) view showing the novel edging pass or stand which imparts the serrations to the flat being processed.
Figure 6:
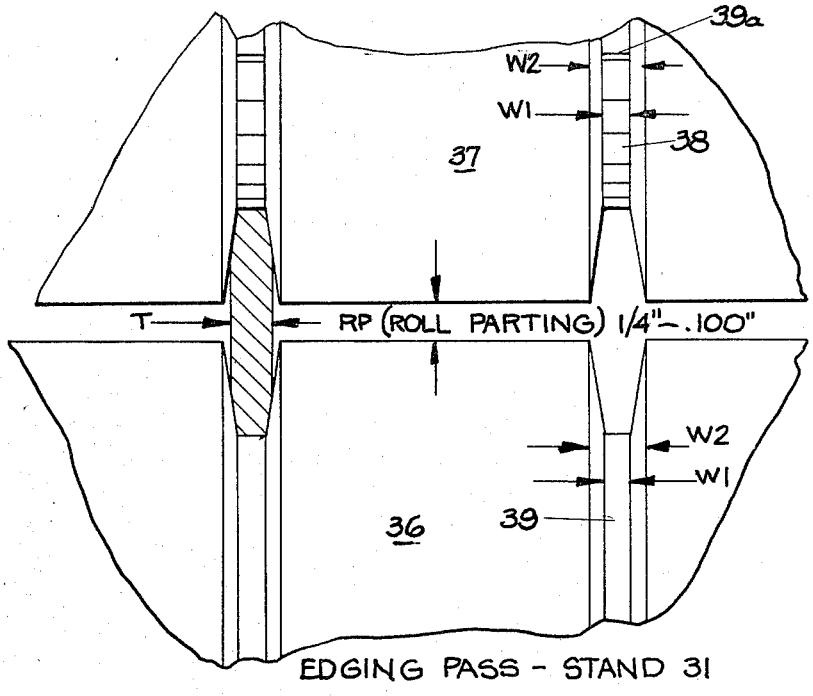
FIG. 6 is a side elevation, partly in section, further illustrating the rolls comprising those used for the edging pass; these are the rolls shown in FIGS. 4 and 5.
Figure 7:
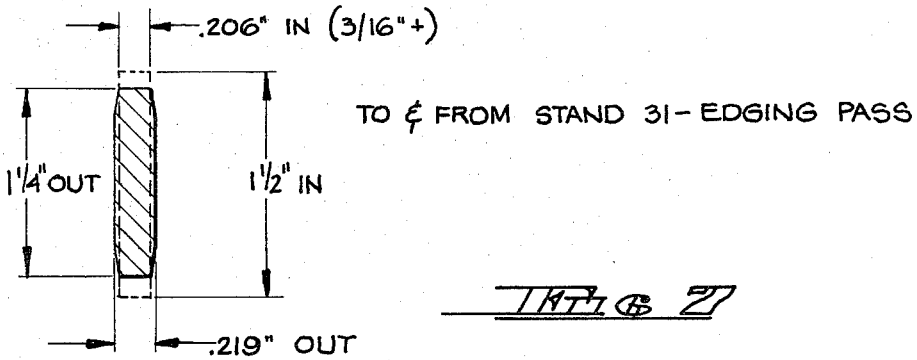
FIG. 7 is a view illustrating the shape of the rolled flat as it enters and leaves the edging pass; the dashed lines show the shape as it enters and the solid with cross hatch show the shape as it leaves.

In this example it was desired to produce a serrated flat in which the serrations were at least 0.065" deep, preferably 0.090" deep. In order to do this it has been discovered that certain procedures and tolerances must be observed. FIGS. 4 and 6 illustrate the rolls 36 and 37 comprising the edging pass of the stand 31. With respect to these Figures the following should be noted. H2 is the height (width) of a non-serrated flat entering the edging pass as accomplished at stand 31. H1 is the height (width) of the now serrated flat leaving this edging pass; this is a finished dimension specified by the customer, in this example $1\frac{1}{4}$". (After leaving the edging pass as accomplished at stand 31 the flat may be slightly trapezoidal and, therefore, will preferably be subject to a final flat pass at stand 32 which may increase this $1\frac{1}{4}$" a trifle.) The invention, however, is complete in the edging stand 31.

T represents the thickness of the finished flat and this is also specified by the customer, in this example 3/16". W1 is the width of the roll groove at its bottom while W2 is the width of the roll groove at the surface of the roll; W2 is preferably slightly greater than W1. RP is the roll parting and in this example by operation of the formula to be set forth, this formula having been derived from experience, the dimension will be a little less than $\frac{1}{4}$". GD is the groove depth, in this example $\frac{1}{2}$". HD represents hole depth, in this example 0.100"; this is to insure that the customer gets a serration of at least 0.065", preferably 0.090".

With the foregoing in mind, it has been found that W1 should be the same as or, preferably, a little greater than T; T, when it enters the edging pass at stand 31, will be greater than the 3/16" (0.188") desired finished dimension—it will actually be about 0.206". W1, therefore, will be about 7/32" (0.219"). T is not worked on during edging.

W2 is preferably greater than W1, simply to make it easier for the flat to enter the roll grooves of the edging pass at stand 31.

Quite importantly, it has been found that H2 minus the sum of both GD's plus RP plus HD should be at least about $\frac{1}{4}$" in order to get the serrations desired. Thus, $H2\text{-}2GD\text{-}RP\text{-}HD \geqq \frac{1}{4}$". H2, when it arrives at the edging stand 31, is known to be $1\frac{1}{2}$"; each GD is known to be $\frac{1}{2}$". By operation of formula, therefore, RP must be no more than $\frac{1}{4}$". Thus, $1\frac{1}{2}$" minus the sum of $\frac{1}{2}$" plus $\frac{1}{2}$" plus RP plus HD equals $\frac{1}{4}$"; therefore RP plus HD must be $\frac{1}{4}$". (If both GD's are changed to 7/16", for example, then RP plus HD would be $\frac{3}{8}$".) By the same token it will be observed that H1 also equals the two GD's plus RP plus HD; therefore H2 minus H1 also equals $\frac{1}{4}$".

From the foregoing it will be apparent that the following relationships exist:

$H1 = 1\frac{1}{4}$" (specified)

$GD = \frac{1}{2}$" (specified)

$HD = 0.100$" (determined to be required)

$RP = \frac{1}{4}$" minus HD, or RP plus $HD = \frac{1}{4}$"

$H1 = 2GD + RP + HD$ $H2 = 2GD + RP + HD + \frac{1}{4}$"

$RP + HD = H2 - H1 = \frac{1}{4}$"

$H2 - H1 \geqq \frac{1}{4}$", or $$\underbrace{2GD + RP + HD + \tfrac{1}{4}''}_{H2} - \underbrace{2GD + RP + HD}_{H1} \geqq \tfrac{1}{4}''.$$

The above criteria were both derived from, and applied to, the problem of providing a serrated flat in which the serrations would be at least 0.065" deep and in which such serrations would be located on about 0.500" centers. In the edging pass at stand 31 (as in all edging passes) the edges only are worked, which is what determines the width of the flat. "Flattening", therefore, does not occur in the primary edging pass (that which takes place at stand 31)—in fact by applying pressure on the ends of the flats, the sides may bow out in the middle of the section. This bow will preferably be rolled out in a flat pass (that which occurs at the flat pass stand 32), returning the section to a true rectangular cross-section, see FIG. 8. The preliminary edging pass, if used, (that which occurs at stand 29), is not related to this slight increase in the width of the primary edging pass.

The instant process is a hot rolling procedure. The key to hot rolling this section, it has been determined, is to maintain a flat thickness W1 as described herein for the flat entering the edging pass at stand 31 and to reduce the width of the flat by at least about $\frac{1}{4}$", this rolling force being required to force the steel up into the holes or notches 38 located in the bottom of the groove **39*a*. If the thickness T of the flat is greater than W1 when it enters the edging pass provided by stand 31, it becomes more difficult to force such thicker section up into the holes 38. (When rolling a smooth edge flat, the section entering the edging pass can be greater than W1** and the product still can be made, but this is not true with the serrated edge flat of this invention.)

A further key to hot rolling serrated flats according to this invention is to provide a proper hole 38 in the bottom of the roll groove **39*a*. This hole must be such as to accommodate the metal as it is forced thereinto and to permit it to leave readily. It has been determined, therefore, that a trapezoidal hole of some sort is required, the trapezoid shape being the cross section of the hole as viewed at right angles to the direction of travel. The top of the hole, measured along the length of the groove, will be greater than the bottom thereof and the hole will be slanted from the outer edges of the top of the hole inwardly to the outer edges of the bottom of the hole. The details of this hole 38 may best be observed and understood with reference to FIG. 5**.

The holes are located on ½" centers. The depth of the hole is 0.100". The angle formed by the end walls of the roll material defining the hole 38 is 45°. The width of the hole, measured across the width of the groove, will be substantially the same as the dimension W1 at the bottom of the roll groove and this will be at least as great, and preferably a little greater, than the width of the flat entering the edging pass at stand 31 comprised of the grooved rolls 36 and 37.

Figure 5:
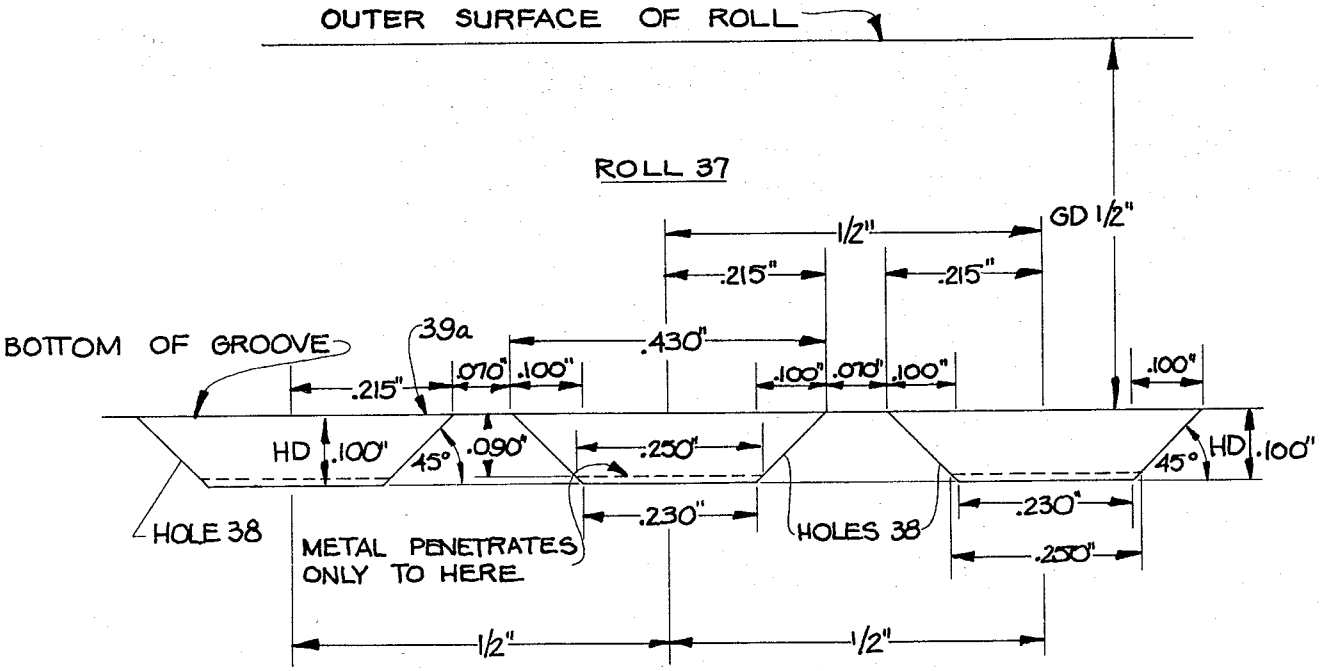
FIG. 5 is a greatly enlarged view of the edging roll disclosed in FIG. 4; this diagramatically illustrates the shape and location of the notch forming holes.

As also illustrated in FIG. 5, the flat material is not quite forced all the way to the bottom of the hole 38; rather, as indicated in the dotted lines in that Figure, the metal penetrates only 0.090" into the hole. As previously indicated the holes 38 are cut into the bottom of the roll groove 39*a* of roll 37 by EDM. Preferably the sides of the hole 38 are sloped at that 45° angle mentioned. It is possible that this angle may be either increased or decreased. As the angle approaches 90°, however, it becomes impossible to force the flat into the holes; also, if forced into a fairly steep hole approaching 90° there could be a hang-up which would prevent the flat from being stripped from the rolls.

By cutting the holes 0.100" deep, and by providing an angle of 45° for the sides of the hole, the length of the bottom of the hole will be 0.230" and the length of the top of the hole will be 0.430". In view of the fact that metal is forced into the hole only to the extent of 0.090", the top of the serration eventually obtained on the flat will correspond to the dotted line in the lower part of the hole illustrated in FIG. 5 and will therefore be 0.250" measured in the longitudinal axis of the flat. It is the EDM technique which permits holes having slanted sides to be cut into the bottom of the groove 39*a* of roll 37. As indicated, the slanting sides are necessary for the ready reception and release of flat material so as to obtain serrations of desired height. It is known that the slope of the sides may be somewhat greater than 45°, and probably with a greater variance in the other direction; straight, 90° holes will not work. The size and spacing of the serrations will also effect the angle of slope. The 45° angle has proved to be quite satisfactory.

Figure 8:
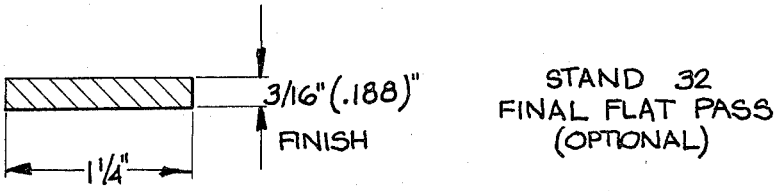
FIG. 8 is a cross sectional view of the finished flat as it leaves an optional flat pass stand; this is the serrated flat resulting from the preferred practice of this invention.

The dimensions of the flat as it leaves the flat pass provided at stand 30 are 1½" by 0.206" (3/16+"). These dimensions, of course, are those of the flat as it enters the edging pass provided by the stand 31 comprised of the grooved roll 36 and the grooved and notched roll 37. Upon leaving this stand 31 the flat dimensions will be 1¼" by 0.219" which is somewhat greater than the 3/16" desired in the final product. Final working of the flat, however, if used, at stand 32 will bring the flat to a rectangular shape of 1¼" by 3/16" (0.188"). (Possibly the 1¼" dimension may be a trifle greater due to the working of the flat, although most of this working results in lengthening of the flat.) The finished product is indicated in FIG. 8.

Figure 9:
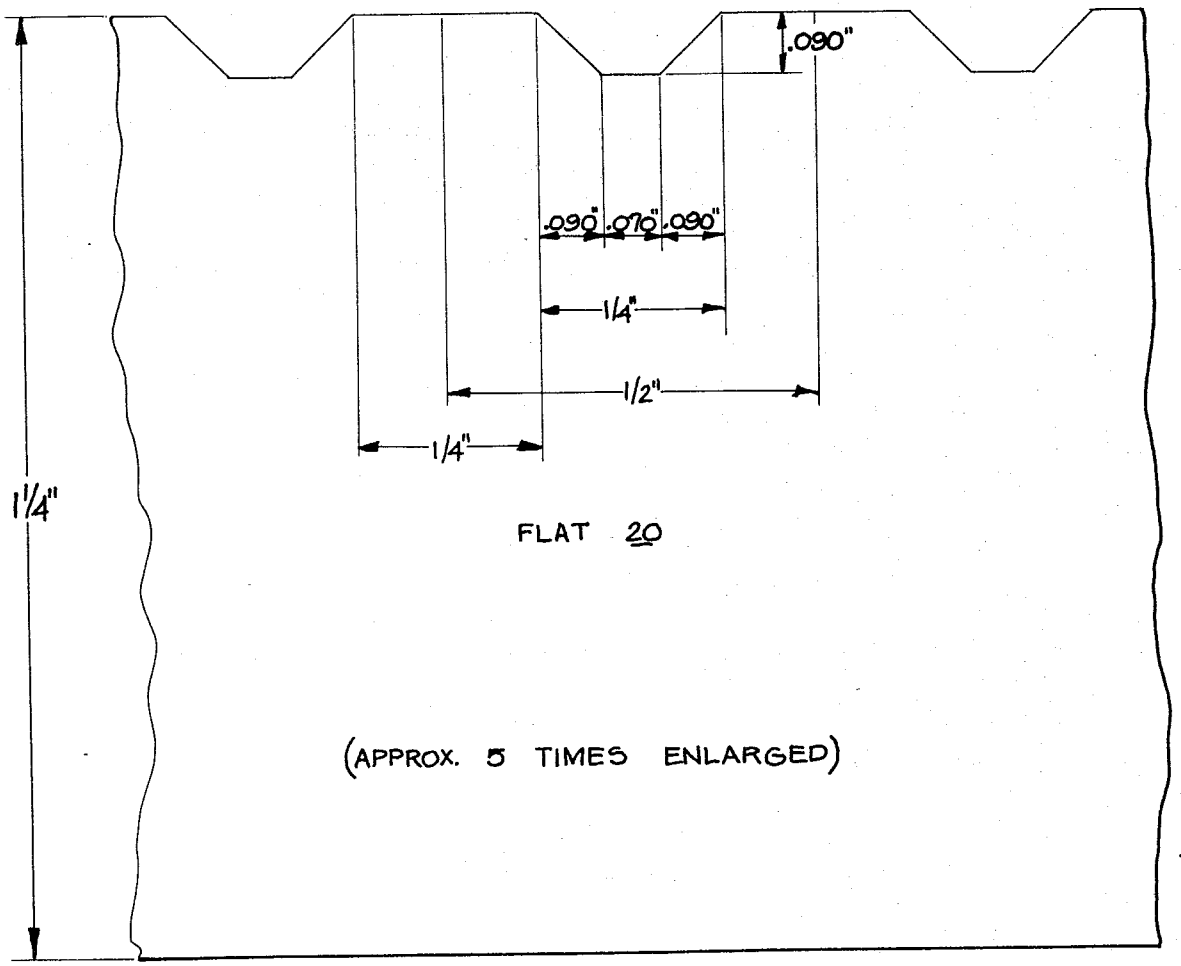
FIG. 9 is a greatly enlarged view of the flat which emerges from the edging rolls depicted in FIGS. 4 and 5; this is the finnished flat of FIG. 8.

The product of FIG. 8, the resultant of the process described in connection with the various rolling stands, including the use of the holes 38 located in the groove 39*a* of roll 37, is also depicted in FIG. 9. From this it is seen that the distance across the top of the serrations measured along the axis of the flat is the same ¼" indicated by the dotted line towards the bottom of the holes 38 as depicted in FIG. 5. The height of the serrations is the same 0.090" illustrated in FIG. 5 wherein the metal is forced not quite to the bottom of the hole 38. The distance of 0.070" between the bottoms of adjacent serrations is the same 0.070" between the top edges of adjacent holes measured along the bottom of the roll groove 39*a*.

Briefly stated, therefore, this invention resides in the hot rolling, preferably of carbon steel bars, to form serrated flats, a unique edging pass being employed and particular care being accorded the various procedures which preceeds it. (It has been mentioned that hot rolling may be carried out above the A3. This A3 designation is commonly referred to as the upper transformation temperature. This is the temperature above which a steel microstructure will be transferred to austenite. Steel is normally hot rolled above A3.) The objective achieved by the invention is to provide a serrated flat with serrations having a predetermined height, the invention having actually produced heights of 0.090". The keys to successful hot rolling according to this invention are to maintain thicknesses of the flat at W1 or less as it enters the novel edging pass and to reduce the width of the flat during that pass by at least about ¼", and to provide a properly sized hole which will permit the steel to be readily forced up into the holes and to release therefrom without hang-up. The resulting product also has a more uniform microstructure due to the hot rolling thereof.

In addition to achieving an improved serrated product, namely, an improved serrated flat for use such as in the manufacture of grating, and for other structural purposes, the novel process of this invention also results in less die wear because of the use of hot rolling techniques, speed of production is tremendously increased, less power is required to operate the equipment, capital for such equipment is minimized, and the product coming off the last stand is ready for end use.

With respect to the FIG. 5 disclosure it is pointed out that the three holes 38 there illustrated are shown as disposed along a straight groove 39*a* located in the roll 37. Obviously these holes are actually located along an arcuate path defined by the groove 39*a*. This will slightly affect the dimensions shown not only in FIG. 5 but also those of FIG. 9. For purposes of description, however, it is believed that the representations in FIGS. 5 and 9 are correct. It should also be noted that the rolls 36 and 37 may be provided with more than one set of grooves 39 and 39*a*. This enables maximum use to be obtained out of these rolls 36 and 37.

Modifications may be made in this invention without departing from the scope and spirit thereof. The invention has been shown and described in terms of certain structures, arrangements, dimensions and methods. It will be apparent to those skilled in the art, however, that changes may be made in these structures, arrangements, dimensions and methods without departing from the inventive concept. It will be understood, therefore, that this invention is not to be restricted to the particular structures, arrangements, dimensions and methods shown and described except insofar as they are specifically set forth in the subjoined claims.

We claim:

1. A method of producing improved finished serrated flats having a predetermined width and thickness which comprises: continuously passing a hot billet of workable metal through a series of rolling stands to form an elongated hot flat; providing an edging pass comprised of a pair of spaced apart edging rolls having aligned, facing grooves, one of said grooves having trapezoidal holes therein; spacing said edging rolls so that the sum of the dimensions of the depth of the grooves and the parting distance of the edging rolls plus the depth of the holes is at least a specified amount less than the predetermined width of the hot flat entering the edging pass, the width of the grooves being at least as great as the thickness of the entering hot flat; and passing said hot flat through the bite of the edging rolls whereby to reduce the hot flat width to that desired in the finished serrated flat while imparting the desired serrations thereto by forcing hot metal to flow into the said trapezoidal holes to the extent necessary to obtain serrations of desired height on said flat.

2. The method of claim 1 as used to produce a finished serrated flat having a final width of 1¼", a final thickness of 3/16", and serrations 0.090" high located on ½" centers, comprising: insuring that the flat entering the said edging pass is 1½" wide and 0.206" thick, the depth of each edging roll groove is ½", the edging rolls are spaced apart ¼" minus 0.100", and the trapezoidal holes are 0.100" deep located on ½" centers, whereby the flat leaving the edging pass is 1¼" wide and at least 3/16" thick.

3. The method of claim 2 including the steps of providing a preliminary edging pass and of insuring that the flat which enters the preliminary edging pass has a width of about 2" and a thickness of about 5/16", and that the flat which leaves said preliminary edging pass has a width of about 1 7/16" and a thickness of about 5/16+", and then passing the flat through a rolling stand located between said edging passes so as to impart thereto the desired width and thickness for entry into the first mentioned edging pass.

4. The method of claim 3 including subjecting the serrated flat to a final flat pass to insure the final thickness of 3/16".

5. The method of claim 1, as used to produce a serrated flat having a final width in the range of about 1¼" to 1½", a final thickness of about 3/16", and serrations in the range of 0.065" to 0.090" high located on about ½" centers, comprising: insuring that the said specified amount is at least ¼", and the depth of said trapezoidal holes is at least 0.100".

6. The method of claim 5 including insuring that the angles the end walls of the said trapezoidal holes make with the bottoms of said holes, considered along the circumference of the groove in which the said holes are located, do not greatly exceed 45°.

7. The method of claim 1 including the step of forming said trapezoidal holes in a said groove by electric discharge machining (EDM).

8. The method of claim 1 as used in the manufacture of grating.

9. The method of claim 1 in which the said hot billet is of carbon steel.

10. The method of claim 9 in which the said hot billet is worked while above its upper transformation temperature.

11. The method of claim 1 including subjecting the flat to a preliminary edging pass to assist in achieving the said predetermined width and said predetermined thicknesses imparted to the flat before the flat is passed through said bite.

12. The method of claim 1 including subjecting the serrated flat to a final flat pass to impart the desired finished thickness thereto.

13. The method of claim 11 including subjecting the serrated flat to a final flat pass to impart the desired finished thickness thereto.

14. The method of claim 1 including insuring that the angles the end walls of the said trapezoidal holes make with the bottoms of said holes, considered along the circumference of the groove in which the said holes are located, do not greatly exceed 45°.

15. The method of claim 1 including insuring that the said spaced apart edging rolls comprising the edging pass conform to the following formulae:

$$H1=2GD+RP+HD;$$

$$H2=2GD+RP+HD+\tfrac{1}{4}'';$$

$$H2-H1\leqq\tfrac{1}{4}'';$$

$$RP=\tfrac{1}{4}''-HD;$$

and $$HD=\text{about } 0.100'';$$

all dimensions being in inches and H1 being the finished width of serrated flat as measured from the non-serrated edge to the top of the serrations, H2 being the width of the flat entering the edging pass, GD being the depth of the groove in each of said spaced apart edging rolls, RP being the parting distance between said edging rolls, and HD being the depth of the said trapezoidal holes.

16. A rolling stand for producing serrated flats from hot billets of workable metal which have been formed into hot flats, comprising: an edging pass comprised of a pair of spaced apart edging rolls having aligned, facing grooves, one of said grooves having trapezoidal holes therein; said edging rolls being spaced so that the sum of the dimensions of the depths of the grooves and the parting distance of the rolls plus the depth of the holes is at least a specified amount less than the known, predetermined width of the hot flat entering said edging pass; the width of the grooves being at least as great as the known, predetermined thickness of the hot flat entering said edging pass; whereby to insure that hot metal flows into said trapezoidal holes to impart serrations to said hot flat.

17. A rolling stand according to claim 16 wherein the edging pass conforms to the following formulae:

$$H1=2GD+RP+HD;$$

$$H2=2GD+RP+HD+\tfrac{1}{4}'';$$

$$H2-H1\leqq\tfrac{1}{4}'';$$

$$RP=\tfrac{1}{4}''-HD;$$

and $$HD=\text{about } 0.100'';$$

all dimensions being in inches and H1 being the finished width of serrated flat as measured from the non-serrated edge to the top of the serrations, H2 being the width of the bar entering the edging pass, GD being the depth of the groove in each of the rolls, RP being the parting distance between said rolls, and HD being the depth of the said trapezoidal holes.

18. A rolling stand according to claim 17 in which H1 is in the range of 1¼" to 1½" and the thickness of the bar entering said edging pass is about 3/16".

19. A method of producing improved serrated flats having a predetermined width and thickness comprising: continuously passing a hot billet of a workable metal through a series of rolling stands to obtain a hot flat; providing an edging pass comprised of a pair of spaced apart edging rolls having aligned facing grooves, one of said grooves having trapezoidal holes therein; the width of said grooves being at least as great as the thickness of the hot flat; the spacing of said edging rolls being such as to sufficiently reduce in width said hot flat to impart serrations of a desired height thereto by forcing hot metal to flow into said trapezoidal holes.

20. An edging stand for use in a mill which shapes a hot billet of workable metal into a hot flat having a predetermined width and thickness suitable to have serrations imparted thereto, said edging stand comprising: a pair of spaced apart edging rolls having aligned facing grooves, one of said grooves having trapezoidal holes therein; the width of said grooves being at least as great as the thickness of the hot flat; and the spacing of said edging rolls being such as to sufficiently reduce in width said hot flat to impart serrations of a desired height thereto by forcing hot metal into said trapezoidal holes.

* * * * *

UNITED STATES PATENT AND TRADEMARK OFFICE

CERTIFICATE OF CORRECTION

PATENT NO. : 4,338,807

DATED : July 13, 1982

INVENTOR(S) : Marion P. Ricono and Harold D. Bridges

It is certified that error appears in the above-identified patent and that said Letters Patent are hereby corrected as shown below:

Column 3, line 54, the last word "of" should be -- or --.

Column 3, line 54, "desiganted" should be designated.

Column 5, line 4, the notation 1 7/6" should be -- 1 7/16" --

Column 5, line 65, the symbol "$\leq$" is reversed in that it should be -- $\geq$ --.

Column 8, line 9 "preceeds" should be -- precede --.

Column 10, claims 15 and 17, the symbol "$\leq$" is again reversed in that the formula should include -- H2 - H1 $\geq$ 1/4" -- rather than the way it is.

Signed and Sealed this

Sixteenth Day of November 1982

[SEAL]

Attest:

GERALD J. MOSSINGHOFF

Attesting Officer

Commissioner of Patents and Trademarks